US009136611B2

(12) United States Patent
Mitchell

(10) Patent No.: US 9,136,611 B2
(45) Date of Patent: Sep. 15, 2015

(54) BLADE ANTENNA ARRAY

(75) Inventor: James P Mitchell, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 696 days.

(21) Appl. No.: 13/398,643

(22) Filed: Feb. 16, 2012

(65) Prior Publication Data

US 2013/0214969 A1 Aug. 22, 2013

(51) Int. Cl.
*H01Q 3/00* (2006.01)
*H01Q 21/08* (2006.01)
*H01Q 1/28* (2006.01)

(52) U.S. Cl.
CPC ..... *H01Q 21/08* (2013.01); *H01Q 1/283* (2013.01)

(58) Field of Classification Search
CPC ..... H01Q 3/00; H01Q 21/08; H01Q 1/283; H04B 7/00
USPC ..... 342/372, 359, 367
See application file for complete search history.

(56) References Cited

U.S. PATENT DOCUMENTS 5,995,041 A 11/1999 Bradley et al.
6,188,913 B1 * 2/2001 Fukagawa et al. ..... 455/562.1
7,583,233 B2 9/2009 Goldberg et al.
7,595,762 B2 9/2009 Mansour
7,636,552 B2 12/2009 Monk
8,547,277 B1 * 10/2013 Mitchell ..... 342/367
8,786,492 B2 * 7/2014 Fuss et al. ..... 342/367
2011/0034191 A1 2/2011 Leabman

FOREIGN PATENT DOCUMENTS

GB 862690 A 3/1961
WO WO 2008134815 A1 11/2008

* cited by examiner

*Primary Examiner* — Harry Liu
(74) *Attorney, Agent, or Firm* — Angel N. Gerdzhikov; Donna P. Suchy; Daniel M. Barbieri

(57) ABSTRACT

A directional antenna system for an aircraft is disclosed. The directional antenna system may include an enclosure, a linear antenna array disposed within the enclosure and a controller. The linear antenna array may include a plurality of antenna elements physically oriented in the same orientation. The plurality of antenna elements may be positioned along a longitudinal axis of the aircraft and spaced apart from each other by a predetermined distance center-to-center. The controller may be in communication with each of the plurality of antenna elements of the linear antenna array. The controller may be configured for independently controlling a RF phase angle of each of the plurality of antenna elements based on a position of the aircraft and at least one ground station available to the aircraft, allowing the linear antenna array to concentrate RF radiations in a particular wavelength toward a general direction.

20 Claims, 14 Drawing Sheets

BLADE ANTENNA ARRAY

CROSS-REFERENCE TO RELATED APPLICATIONS

This application is related to co-pending U.S. patent application Ser. No. 13/090,792 filed on Apr. 20, 2011 and entitled "Air-To-Ground Antenna," which is incorporated herein by reference.

This application is also related to co-pending U.S. patent application Ser. No. 13/215,352 filed on Aug. 23, 2011 and entitled "Cellular Based Aviation Video System," which is incorporated herein by reference.

This application is further related to co-pending U.S. patent application Ser. No. 13/215,607 filed on Aug. 23, 2011 and entitled "Air-To-Ground Communications System and Method," which is incorporated herein by reference.

TECHNICAL FIELD

The present disclosure relates generally to communication systems and more particularly to a directional antenna suitable for air-to-ground communications.

BACKGROUND

Broadband data solutions for mobile phones and portable computers have become increasingly popular and necessary. However, providing data solutions that achieve the desired bandwidth may be difficult in certain situations. One example of such a situation is air travel, as conventional mobile phones are very undependable during flight as they do not transmit at a high enough power to maintain communication with the ground networks. Furthermore, many world-wide spectrum regulators have not approved the uncontrolled RF emissions from cellular devices onboard aircraft.

Certain aircraft communication systems have been developed to provide in-flight data solutions. Such a system may utilize a set of custom towers on the ground that point their signals upwards (towards the sky) to communicate with receivers installed on aircrafts. The receivers and the set of custom towers work similarly to that of conventional mobile phones and cell towers. While in-flight data solutions may be provided utilizing such systems, they are very expensive to develop/operate, and they duplicate the mobile phone equipment people already have and would prefer to use. Furthermore, the receivers used in such a system are generally omnidirectional, which may have limited antenna gain due to lack of directionality. Limited antenna gain results in limited data rate, which is undesirable for a broadband data solution. In addition, developing and operating a set of custom towers for communication purposes is subject to various regulations. As a result, for example, certain aircraft communication systems currently in operation are restricted to horizontal polarization only, and there may be very little benefit even if dual polarization antennas are used in such systems.

Conventional ground-based cellular networks may provide a low-cost broadband option for in-flight data solutions. In addition, communication standards such as Long Term Evolution (LTE), 3GPP, UMTS, WiMax and other 4G and 5G type technologies as employed without modification by the cellular network carriers may enable more in transit bandwidth capacity compared to the bandwidth provided by the custom towers of the aircraft communication system described above. Therefore, it may be appreciated to provide the ability for an aircraft to communicate with existing ground-based cellular networks and to provide in-flight data solutions utilizing the ground-based cellular networks. In addition, such cellular networks already have established data communication infrastructures, which may be utilized without the need to build custom towers as required in other in-flight data solutions.

However, the elevated position of the aircraft may pose issues with ground networks because of the possibility of illuminating or receiving signals from many ground stations/towers in the same band. This may cause the antenna located on the aircraft to induce or transmit signals to and/or receive signals from more than one tower at once. Studies have shown that such behaviors may desensitize receivers at both ends and introduce interferences (for example, as shown in: *LTE for UMTS*, Harri Holma et al., page 315). Furthermore, the signals provided by the conventional ground stations (cell towers) may not be directed upwardly towards the flying aircraft. In addition, the antenna located on the aircraft may also need to satisfy certain physical constraints.

Therein lies the need to provide an antenna suitable for communicating with ground stations.

SUMMARY

The present disclosure is directed to a directional antenna system for an aircraft. The directional antenna system may include an enclosure, a linear antenna array disposed within the enclosure and a controller. The linear antenna array may include a plurality of antenna elements physically oriented in the same orientation. The plurality of antenna elements may be positioned along a longitudinal axis of the aircraft and spaced apart from each other by a predetermined distance center-to-center. The controller may be in communication with each of the plurality of antenna elements of the linear antenna array. The controller may be configured for independently controlling a RF phase angle of each of the plurality of antenna elements based on a position of the aircraft and at least one ground station available to the aircraft, allowing the linear antenna array to concentrate RF radiations in a particular wavelength toward a general direction.

A further embodiment of the present disclosure is also directed to a directional antenna system for an aircraft. The directional antenna system may include an enclosure, a linear antenna array disposed within the enclosure, a tilt mechanism and a controller. The linear antenna array may include a plurality of antenna elements physically oriented in the same orientation. The plurality of antenna elements may be spaced apart from each other by a predetermined distance center-to-center. The tilt mechanism for the linear antenna array may be configured for providing mechanical tilting of the linear antenna array. Furthermore, the controller may be in communication with the tilt mechanism and each of the plurality of antenna elements of the linear antenna array. The controller may be configured for controlling the tilt mechanism and a RF phase angle of each of the plurality of antenna elements, allowing the linear antenna array to concentrate RF radiations in a particular wavelength toward a general direction.

An additional embodiment of the present disclosure is directed to another directional antenna system for an aircraft. The directional antenna system may include an enclosure, a first linear antenna array disposed within the enclosure, a second linear antenna array disposed within the enclosure, and a controller. The first linear antenna array may include a plurality of antenna elements physically oriented in a first orientation and spaced apart from each other by a predetermined distance center-to-center; the second linear antenna array may include a plurality of antenna elements physically oriented in a second orientation and spaced apart from each other by the predetermined distance center-to-center. The controller may be in communication with the each of the plurality of antenna elements of the first linear antenna array and each of the plurality of antenna elements of the second linear antenna array. The controller may be configured for selectively activating at least one of the first linear antenna array or the second linear antenna array. The controller may be further configured for independently controlling a RF phase angle of each of the plurality of antenna elements of the first linear antenna array and each of the plurality of antenna elements of the second linear antenna array, allowing the linear antenna array to concentrate RF radiations in a particular wavelength toward a general direction.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to exemplary embodiments of the disclosure, examples of which are illustrated in the accompanying drawings.

A directional antenna such as that disclosed in co-pending U.S. patent application Ser. No. 13/090,792 filed on Apr. 20, 2011 and entitled "Air-To-Ground Antenna" may be installed in the nose section of the aircraft to provide communications with ground stations/towers of a cellular network. However, not all aircraft may have the space in the nose section to accommodate such an antenna.

The present disclosure is directed to a directional antenna that is configured to be physically small to minimize its air drag, and may be installed on the outside surface of any aircraft. In one embodiment, the directional antenna in accordance with the present disclosure may be installed on a downwardly facing surface of the aircraft (e.g., on the bottom of the fuselage) and utilized to provide communications with ground stations/towers of a cellular network.

Figure 1:
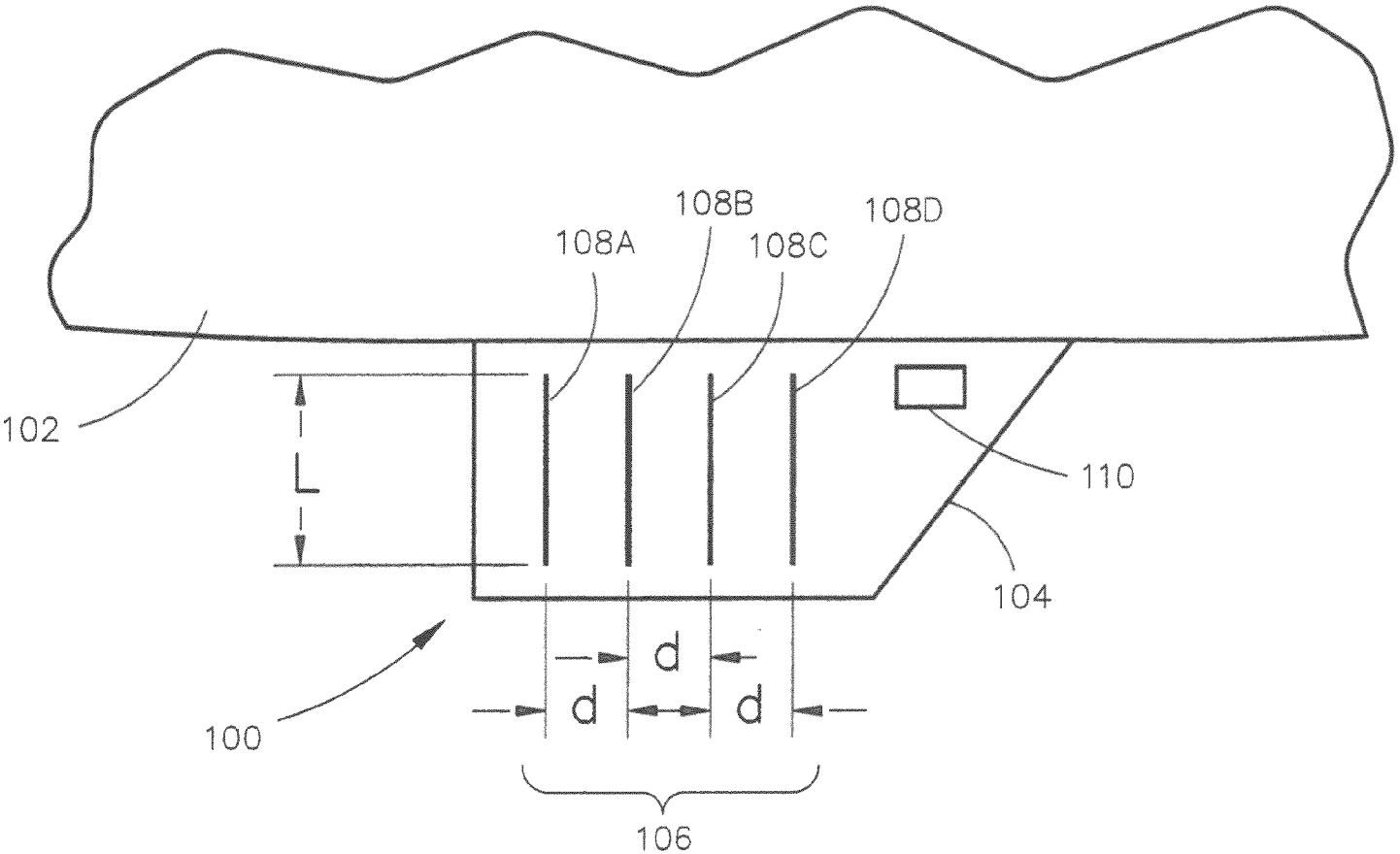
FIG. 1 is an illustration depicting a directional antenna system installed on the bottom of an aircraft.
Figure 2:
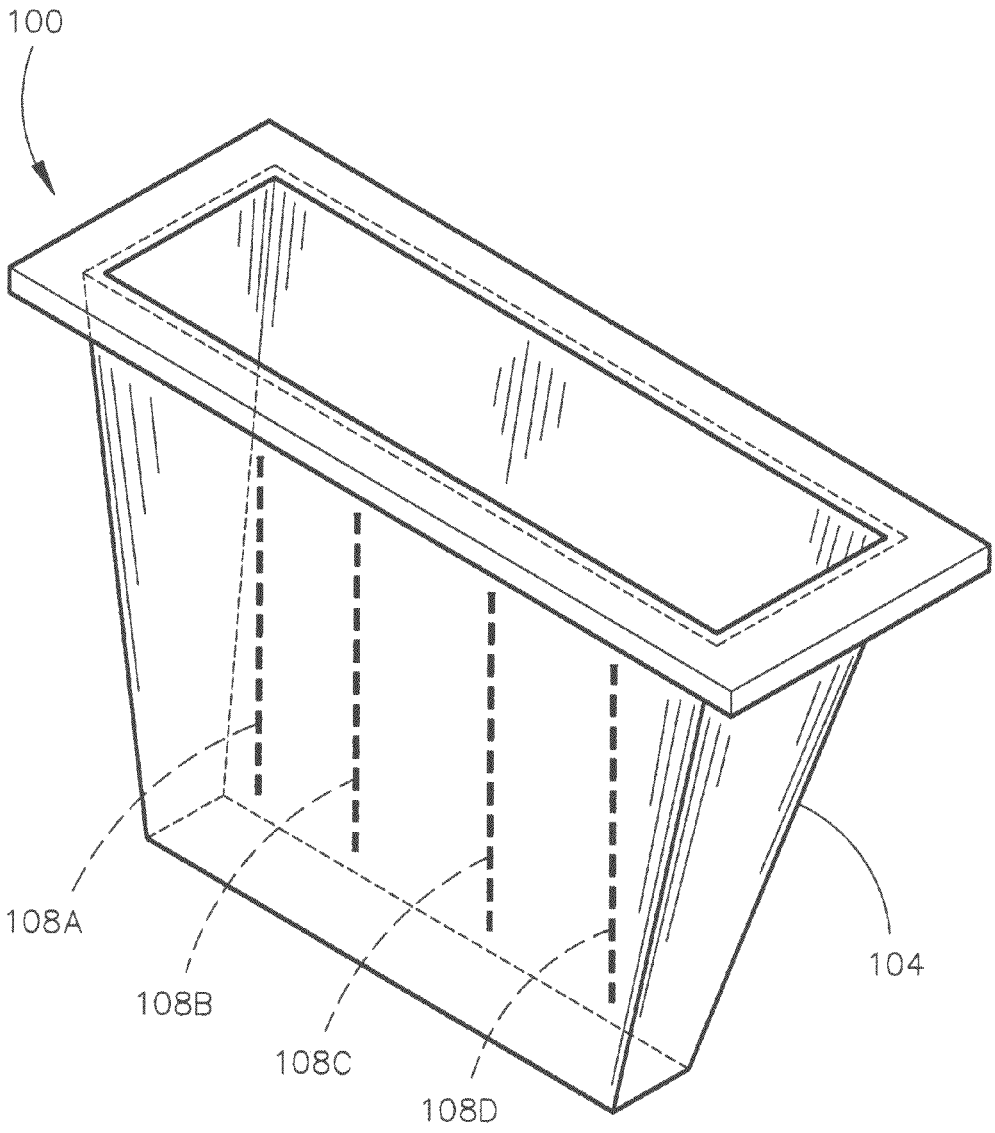
FIG. 2 is an isometric view of the directional antenna system of FIG. 1.

Referring generally to FIGS. 1 and 2, illustrations depicting a directional antenna system 100 installed on the bottom of an aircraft 102 are shown. The directional antenna system 100 includes an enclosure 104 and a linear antenna array 106 disposed within the enclosure. The linear antenna array 106 includes a plurality of antenna elements 108 physically oriented in the same orientation. For instance, in the example illustrated in FIGS. 1 and 2, the antenna elements 108 are oriented so that they are perpendicular to the lateral axis of the aircraft.

Each antenna element 108 may be configured as a blade antenna, a dipole antenna, a monopole antenna, a patch antenna, a folded antenna, a loop antenna, or a stripline antenna or the like. Arranging the plurality of antenna elements 108 to form the linear antenna array 106 allows for better control of RF propagation direction than a single antenna element. Generally, a linear antenna array having more antenna elements may provide better directional control. Therefore, it is contemplated that the linear antenna array 106 may include more than two antenna elements without departing from the spirit and scope of the present disclosure.

In one embodiment, the antenna elements 108 of the linear antenna array 106 are configured for communicating with ground stations. For example, each antenna element may be implemented as a blade antenna configured for operating with GSM, CDMA, LTE, WiMax, future 5G standards or the like within the 698-3600 MHz spectrum region, commonly designated for commercial and public safety uses in the United States and other countries world-wide. It is contemplated that additional antenna elements may be added or the existing elements may be adapted to support more than one frequency band designated for other standards and purposes and/or in other countries.

Furthermore, as illustrated in FIG. 1, the antenna elements 108 are spaced apart from each other by a predetermined distance d center-to-center. In one embodiment, the predetermined distance d is approximately one quarter of the wavelength that the antenna elements 108 are configured to operate with (e.g., about 4 inches for a 700 MHz band implementation). However, it is contemplated that the distance between two adjacent antenna elements 108 may vary without departing from the spirit and scope of the present disclosure.

The directional antenna system 100 further includes a controller 110 in communication with each antenna element 108 of the linear antenna array 106. The controller 110 may be implemented as a processing unit, a computing device, an integrated circuit, or any control logic (stand-alone or embedded) in communication with the antenna elements. The controller may be located within the enclosure 104 if space permits. Alternatively, the controller may be located elsewhere on the aircraft and communicate with the antenna elements via wired or wireless communication means. The controller 110 is configured to operate and control the RF phase angle of each antenna elements 108, allowing the linear antenna array 106 to concentrate RF radiations in the operating wavelength toward a general direction. The directionality helps reducing the number of ground stations visible to the linear antenna array 106, therefore reducing transmit and receive interference effects. In addition, the directionality helps increasing antenna gain, therefore providing greater data rate which is appreciated in broadband applications.

Figure 3:
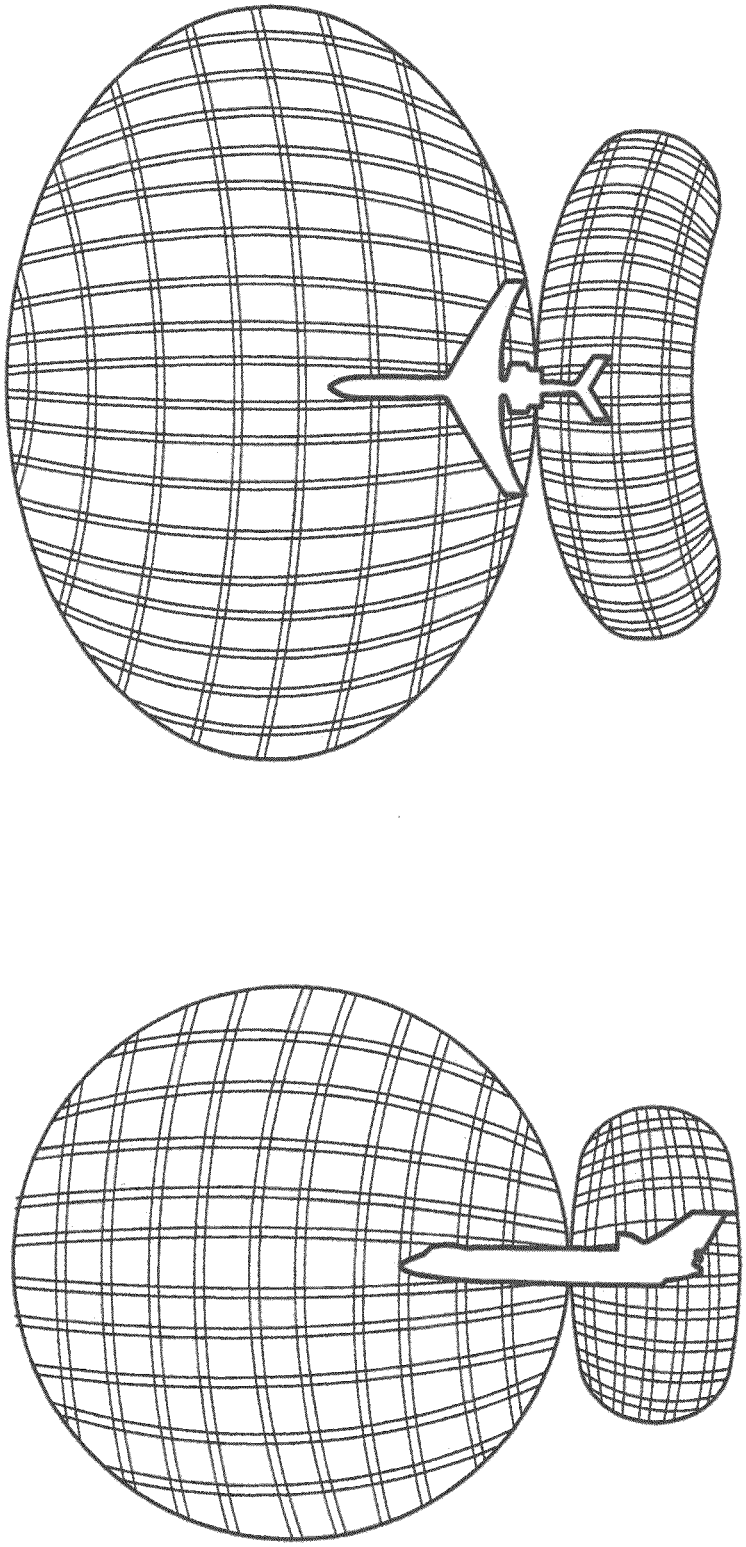
FIGS. 3 through 5 are illustrations depicting the directional beams provided by the directional antenna system of FIG. 1.
Figure 4:
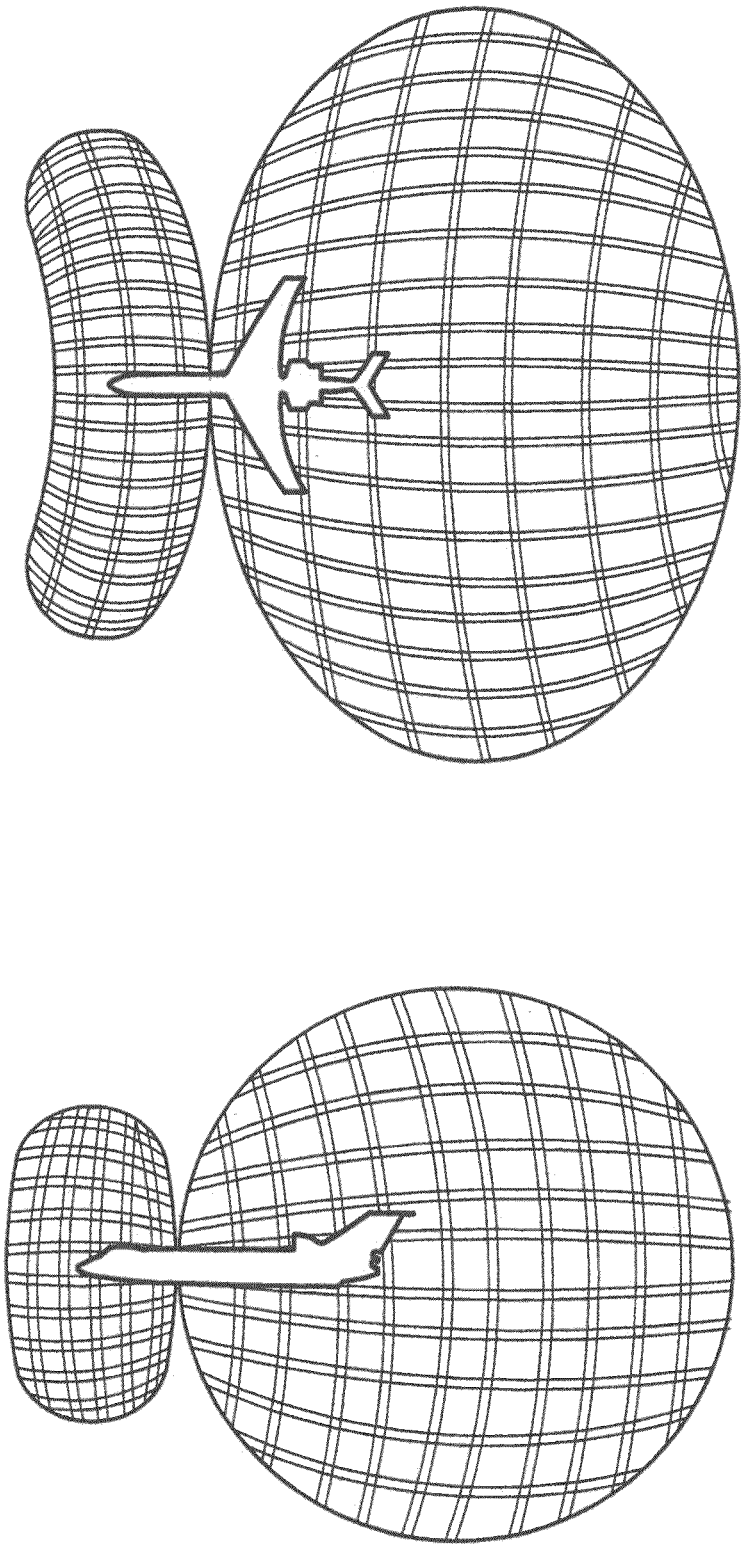
Figure 5:
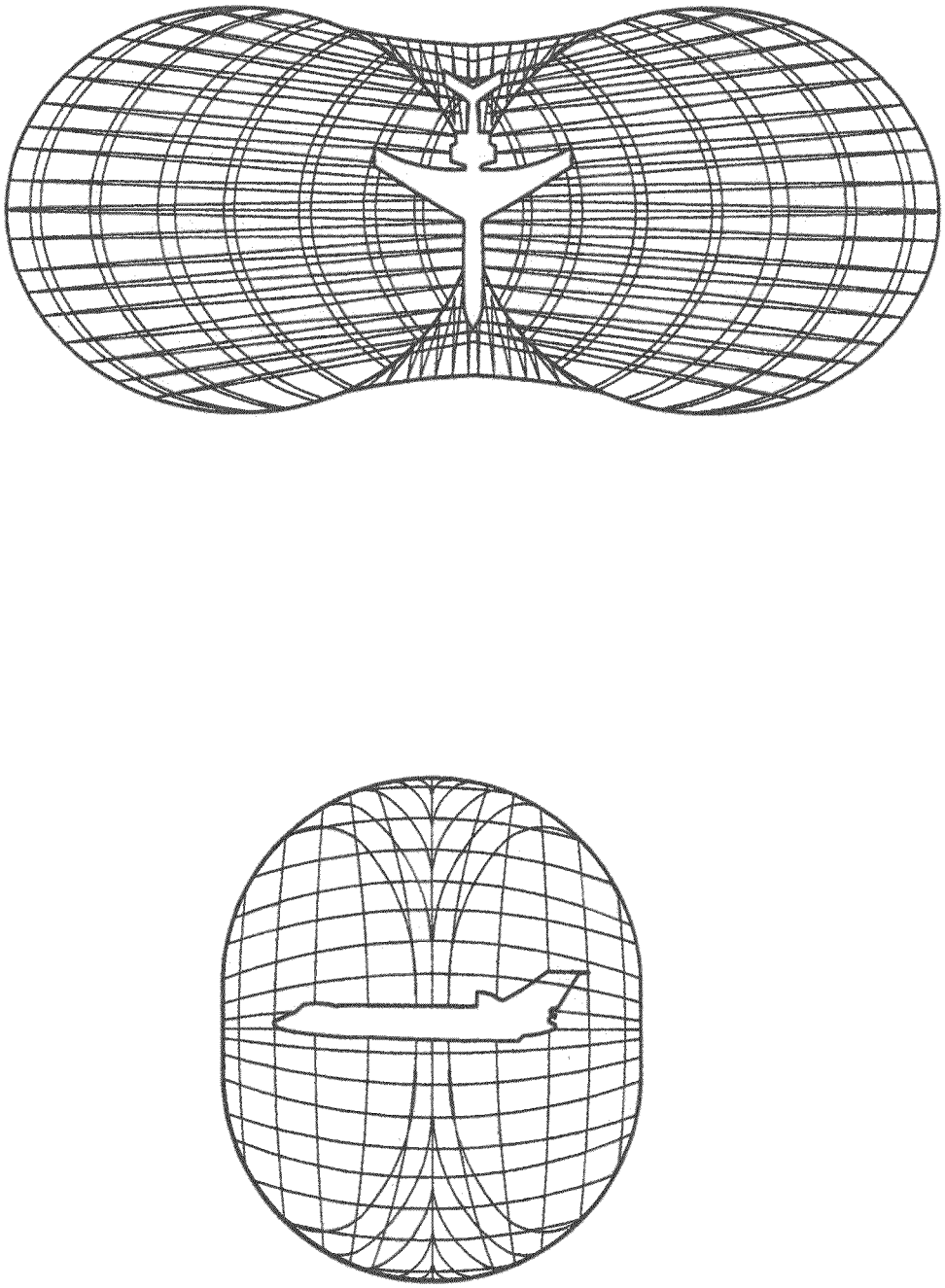

Referring generally to FIGS. 3 through 5, illustrations depicting the directional beams provided by the linear antenna array 106 are shown. In a specific configuration, the linear antenna array 106 may include four antenna elements 108A through 108D. Furthermore, the linear antenna array 106 may be arranged in a manner such that the antenna elements 108A through 108D are positioned along the longitudinal axis of the aircraft 102.

The controller 110 may control the linear antenna array 106 by switching delay lines to each antenna elements to control the RF phase angle of each respective antenna elements. For instance, to concentrate the directional beam provided by the linear antenna array 106 in a generally forward direction (all directions referred herein are with respect to the direction of travel of the aircraft) as depicted in FIG. 3, the controller 110 may introduce a phase angle of 0° (i.e., no delay) to the first antenna element 108A, a phase angle of 90° to the second antenna element 108B, a phase angle of 180° to the third antenna element 108C, and a phase angle of 270° to the fourth antenna element 108D.

In addition, to concentrate the directional beam provided by the linear antenna array 106 in a generally rearward direction as depicted in FIG. 4, the controller 110 may introduce phase angles (270°, 180°, 90°, 0°) to the antenna elements 108A through 108D, respectively. Furthermore, to concentrate the directional beam provided by the linear antenna array 106 towards the side of the aircraft as depicted in FIG. 5, the controller 110 may introduce phase angles (0°, 0°, 0°, 0°), i.e., no phase angle adjustment, to the antenna elements 108A through 108D, respectively.

It is understood that the phase angles applicable to each antenna element described above are merely exemplary. The controller 110 may introduce different RF phase angles to different antenna elements in order to concentrate the directional beam provided by the linear antenna array 106 toward various directions. It is contemplated that the controller 110 may also control the antenna gain (power) of each antenna elements. Furthermore, it is understood that the number of antenna elements included in the linear antenna array 106 is merely exemplary. A linear antenna array in accordance with the present disclosure may include various numbers of antenna elements without departing from the spirit and scope of the present disclosure.

The linear antenna array in accordance with the present disclosure is configured to be physically small to minimize its air drag when installed on the outside surface of the aircraft. For example, in a 700 MHz band implementation, the antenna elements 108 may be approximately half of the wavelength long (e.g., l=8 inches), and the entire antenna array may be enclosed inside the aerodynamically shaped enclosure 104. It is contemplated that the specific configuration and dimension of the antenna array may vary based on the particular band that the antenna array is configured to operate with.

Figure 6:
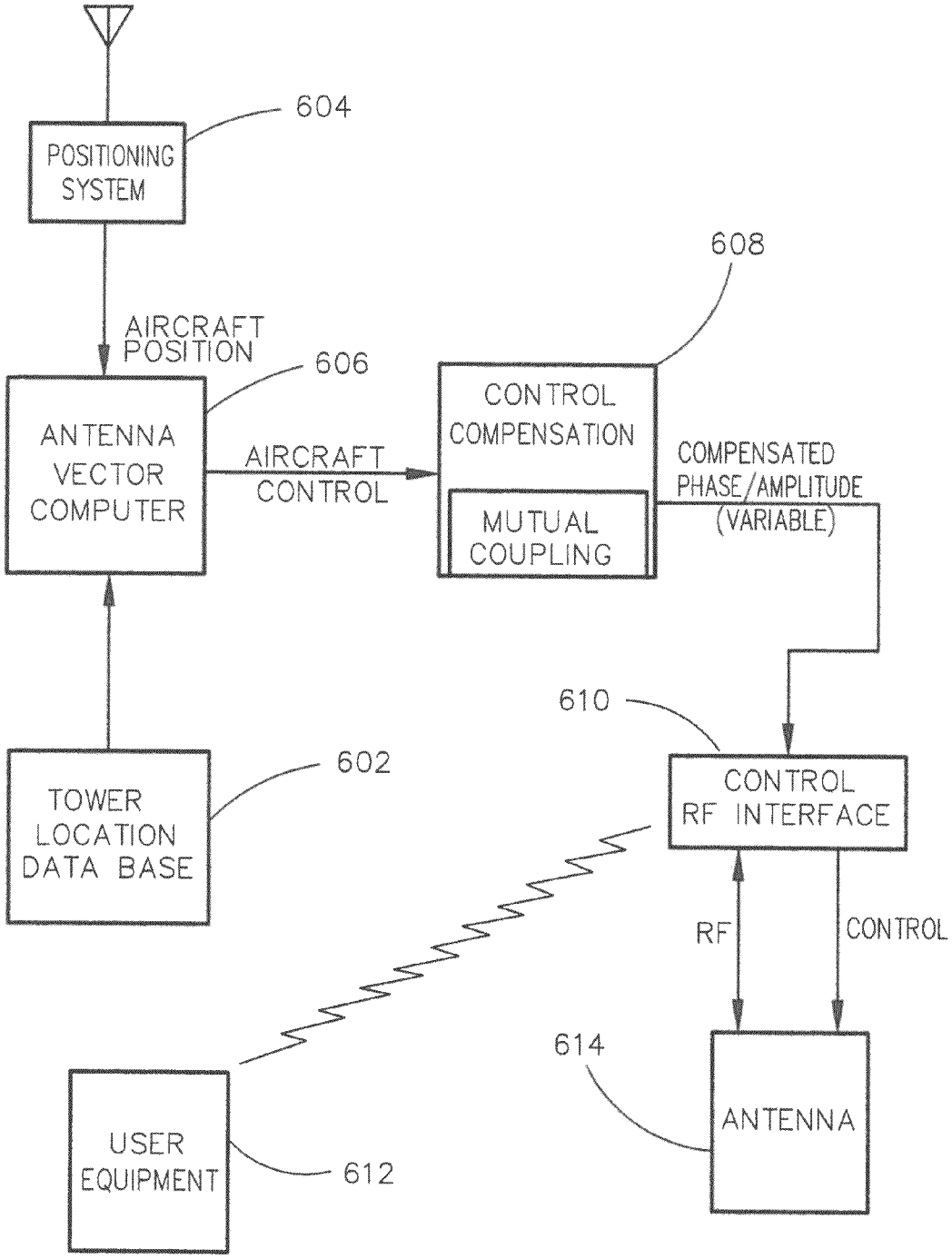
FIG. 6 is a block diagram illustrating the directional antenna system utilized on the aircraft.

In one embodiment, the controller 110 utilized to control the operation of the antenna array 106 is configured to adjust the RF phase angles of the antenna elements 108 based on the available ground stations and the location of the aircraft. FIG. 6 shows a block diagram depicting such a configuration. For instance, the locations of the ground stations, their tower height and beam directions may be known (e.g., provided by the cellular service providers) and stored in a database 602. In addition, the current location (e.g., latitude, longitude and altitude) and the direction of travel of the aircraft may also be determined utilizing a positioning system 604 (e.g., a global positioning unit (GPS), an inertial navigation system (INS), or the like). Based on the current location and the direction of travel of the aircraft, an antenna vector computer 606 may determine the available/visible ground stations and the direction which the antenna array 614 should point to in order to maximize connectivity and minimize interferences.

A control compensation unit 608 may then process the antenna control information generated by the antenna vector computer 606 and provide the compensated phase, amplitude and/or delay control settings to the controller 610, which in turn controls the operations of the antenna array 106. Also as indicated in FIG. 6, the controller 610 may also serve as the RF interface between the antenna array 106 and various user equipment/devices 612 onboard the aircraft, allowing such devices (e.g., entertainment devices, mobile phones or various other communication devices) to communicate with the ground stations.

Furthermore, the controller 610 may also be utilized to control the transmit power of the antenna based on the RF visibility with available ground stations and the location of the aircraft. An exemplary system and method for controlling transmit power and/or steering antenna of a mobile communication system in air-to-ground communications is disclosed in co-pending U.S. patent application Ser. No. 12/891,107 filed on Sep. 27, 2010 and entitled "Doppler Compensated Communications Link," which is incorporated herein by reference.

While the directional antenna system as describe above may be sufficient for providing communication with ground stations, it is contemplated that providing the ability for the linear antenna array to direct its beam slightly downward may further improve the communication efficiency. That is, directing the beam downward may improve discrimination from other unwanted towers and therefore minimize interferences.

Figure 7:
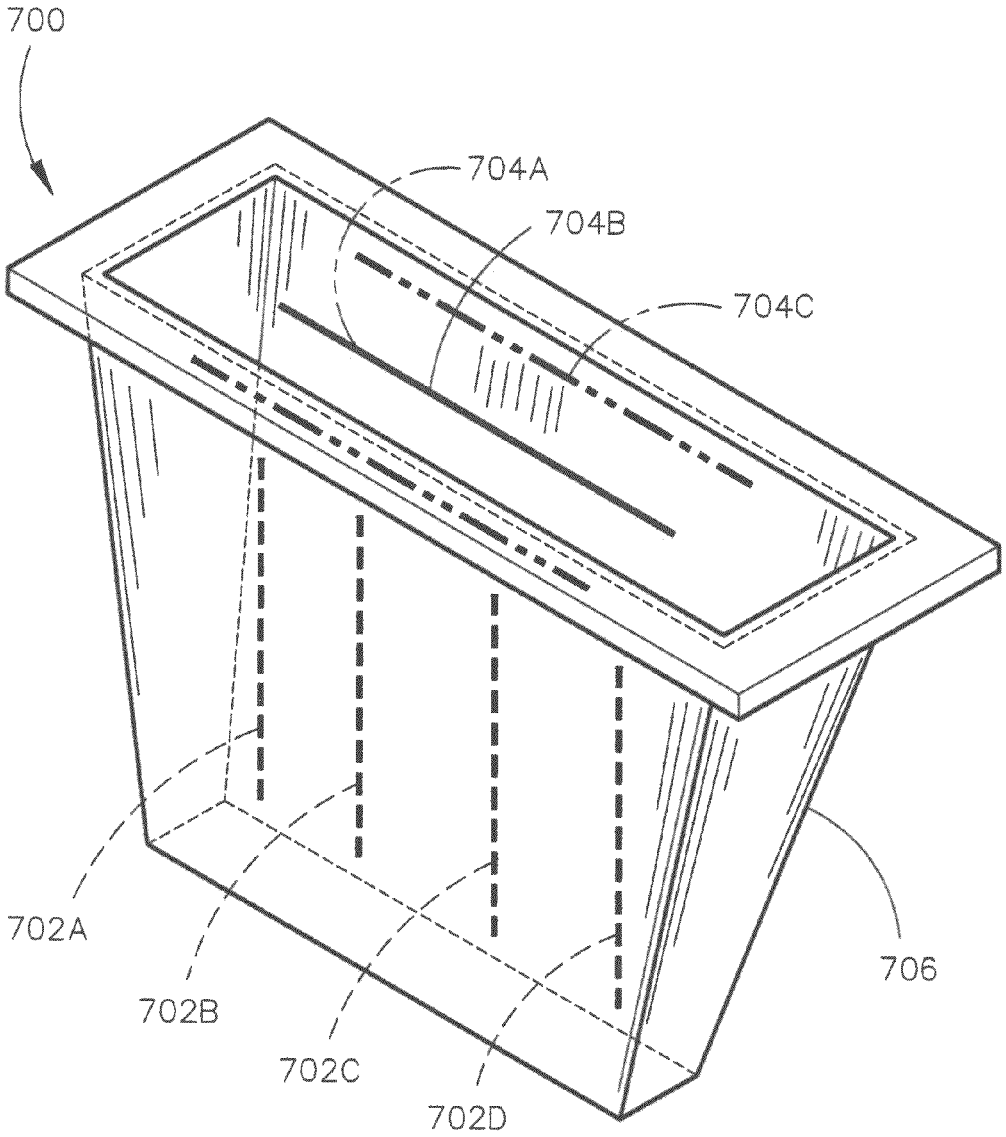
FIG. 7 is an isometric view of another directional antenna system in accordance with the present disclosure.

FIG. 7 shows an exemplary directional antenna system 700 with two orthogonal linear antenna arrays. In one embodiment, the antenna system 700 may include a plurality of vertical antenna elements 702 arranged in a similar manner as the antenna elements 108 described above. The antenna system 700 may also include one or more horizontal element 704 oriented generally perpendicular with respect to the antenna elements 702. While the horizontal element(s) 704 depicted in FIG. 7 may be shown to be placed in the base plate of the antenna enclosure 704, it is understood that such a placement is merely exemplary, and that the horizontal element(s) 704 may be placed elsewhere in the enclosure 706 as long as they are evenly spaced apart from each other (if there are more than one horizontal element 704) and are oriented generally perpendicular with respect to the antenna elements 702.

In a particular configuration, the antenna system 700 may include four vertical antenna elements 702A through 702D and three horizontal antenna elements 704A through 704C. It has been observed that introducing RF phase angles (180°, 180°, 180°) to the horizontal antenna elements 704A through 704C while the vertical antenna elements 702A through 702D are in operation directs the RF beam of the antenna system 700 downward.

Figure 8:
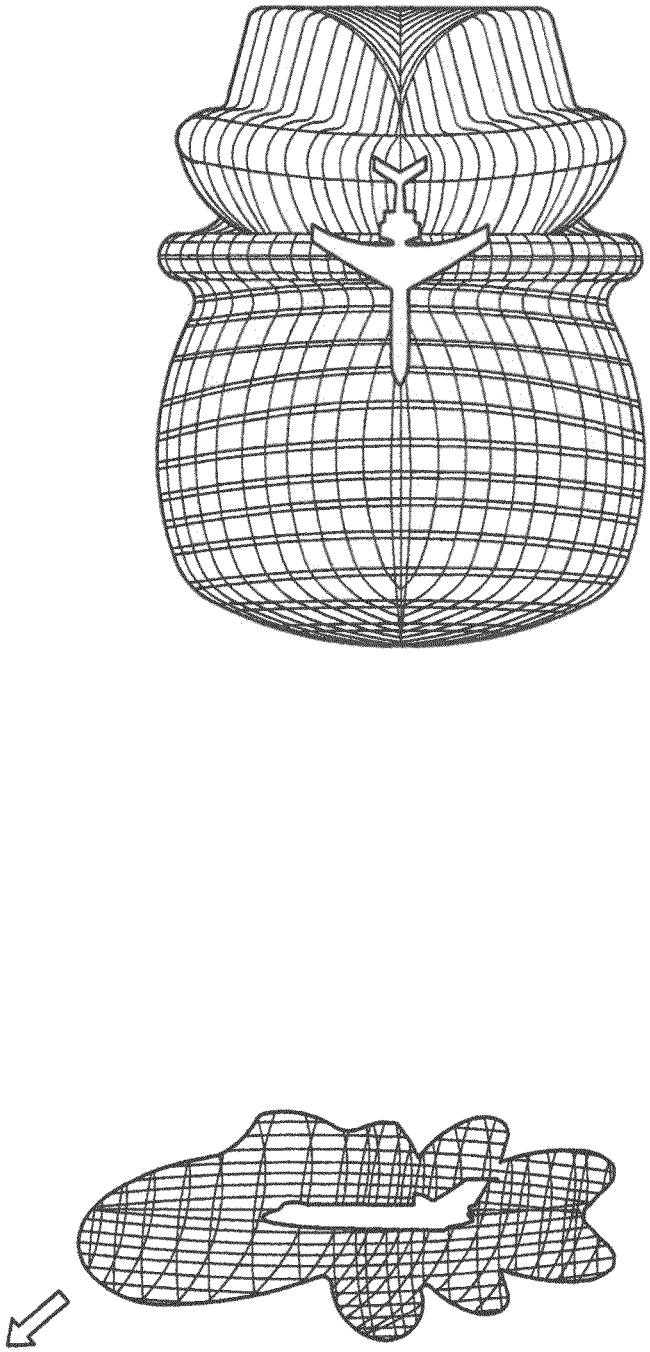
FIGS. 8 through 9 are illustrations depicting the directional beams provided by the directional antenna system of FIG. 7.

FIG. 8 depicts the directional beams provided by the antenna system 700 when RF phase angles (0°, 90°, 180°, 270°) are introduced to the vertical antenna elements 702A through 702D, respectively (i.e., to direct the beam forward as described above) and RF phase angles (180°, 180°, 180°) are introduced to the horizontal antenna elements 704A through 704C, respectively. It is contemplated that the horizontal antenna elements may also be activated to direct the beams downward when the vertical antenna elements are phased for providing rearward or side beams.

Figure 9:
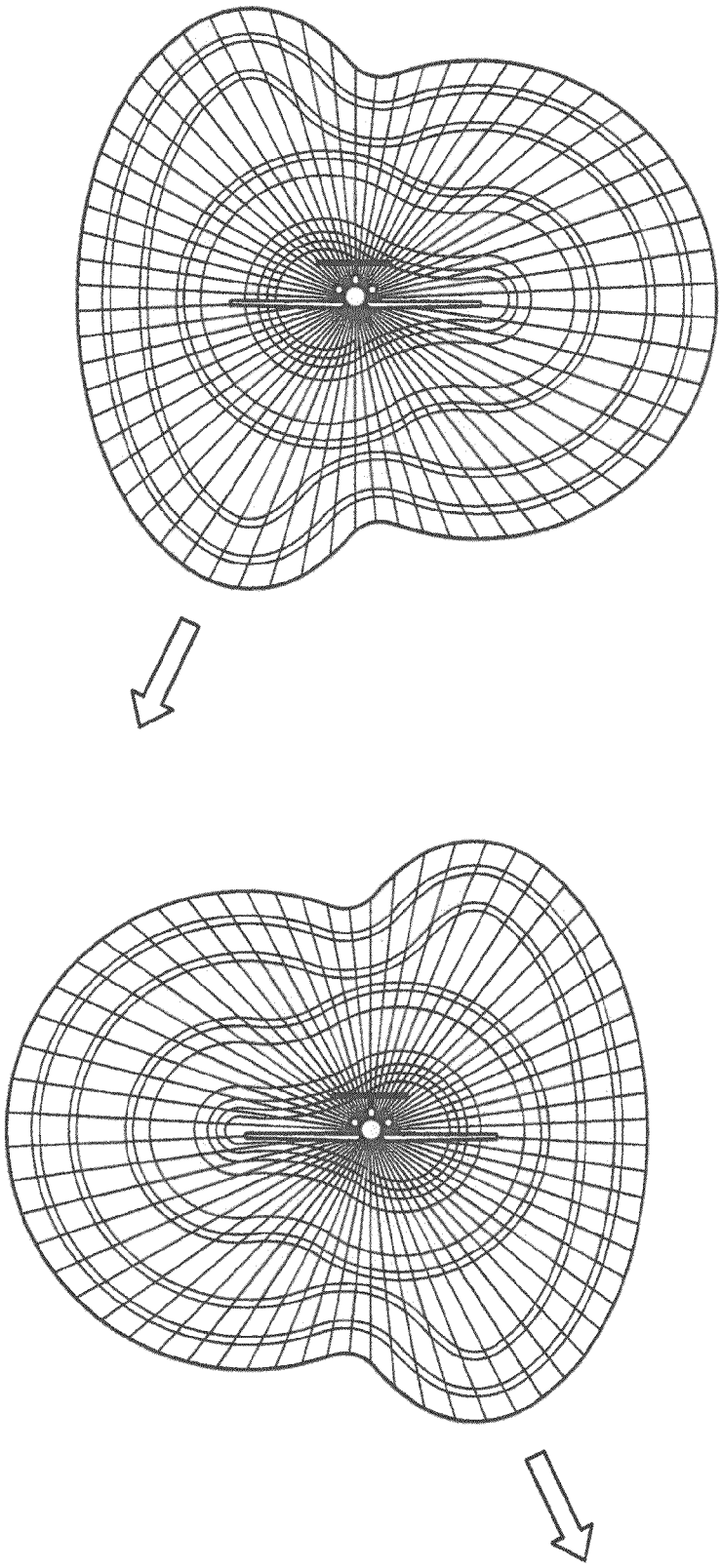

In addition, the antenna system 700 may selectively activate only the horizontal antenna elements 704A through 704C in the example above, allowing the antenna system 700 to concentrate its RF radiations slightly towards the left or the right of the aircraft as depicted in FIG. 9. For example, RF phase angles (90°, 180°, 270°) may be introduced to the horizontal antenna elements 704A through 704C, respectively, to allow the antenna system 700 to concentrate its RF radiations slightly towards the right (with respect to the direction of travel) of the aircraft. In another example, RF phase angles (270°, 180°, 90°) may be introduced to the horizontal antenna elements 704A through 704C, respectively, to allow the antenna system 700 to concentrate its RF radiations slightly towards the left (with respect to the direction of travel) of the aircraft.

The antenna system having both vertical and horizontal linear array in accordance with the present disclosure may be appreciated in various applications. The steerable beams from the vertical array, the horizontal array or both arrays enable directional beam pointing capabilities generally only available in large size antennas (which are not suitable for the outside of an aircraft). The small physical profile of the antenna system in accordance with the present disclosure is therefore well suited for providing communications with ground stations, especially for smaller aircraft. It is understood, however, that the two orthogonal linear arrays in accordance with the present disclosure are not required to be oriented in the vertical and horizontal manner (with respect to the lateral axis of the aircraft). They may be offset from the positions shown in the exemplary figures as long as they remain orthogonal with respect to each other.

Figure 10:
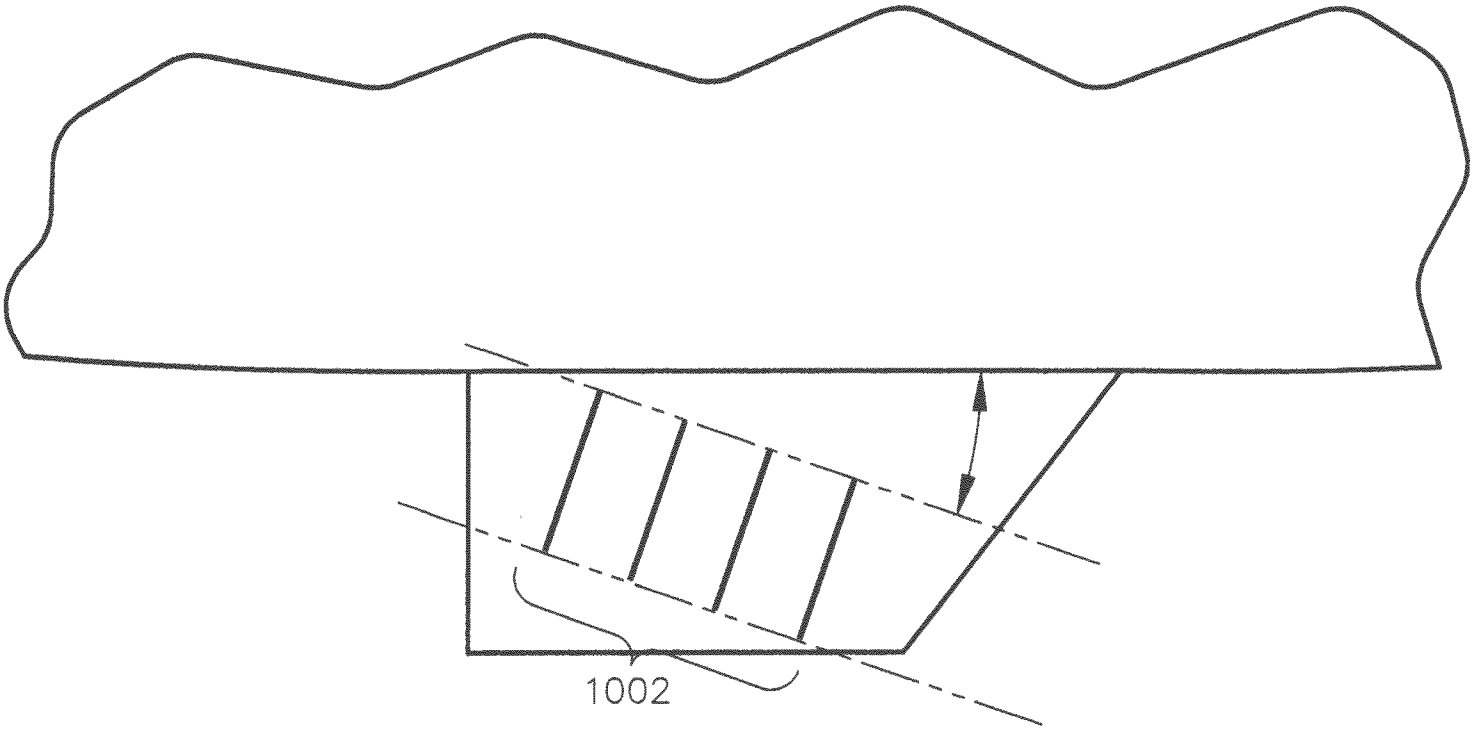
FIG. 10 is an illustration depicting a directional antenna system with a tilt mechanism.

While the directional antenna system as describe above may be sufficient for providing communication with ground stations, it is contemplated that a tilt mechanism for the linear antenna array may be utilized to further improve the communication efficiency. For instance, the tilt mechanism may be configured for providing mechanical downtilt for the linear antenna array 1002 as illustrated in FIG. 10, which may be appreciated when the aircraft is in an elevated position during flight. Downtilting the linear antenna array 1002 in this manner may help matching the radiation pattern of the antenna array 1002 to the radiation pattern of the ground tower, therefore optimizing the coverage. In one embodiment, the tilt mechanism may provide linear downtilt of the linear antenna array 1002 for up to approximately 90 degrees. Alternatively, the tilt mechanism may be configured for providing mechanical tilt for the antenna array 1002 in various other directions in addition to a linear downtilt. Furthermore, the mechanism may be configured to allow the antenna array 1002 to be mechanically tilted/rotated towards any direction as needed.

It is contemplated that the tilt mechanism may be implemented utilizing various types of mechanical devices without departing from the spirit and scope of the present disclosure. It is also contemplated that the tilt mechanism may also be utilized for mechanically tilting/rotating antenna systems with orthogonal linear antenna arrays as previously described. It is further contemplated that the tilt mechanism may be controlled by the antenna system controller based on the available ground stations and the location of the aircraft as described above.

Figure 11:
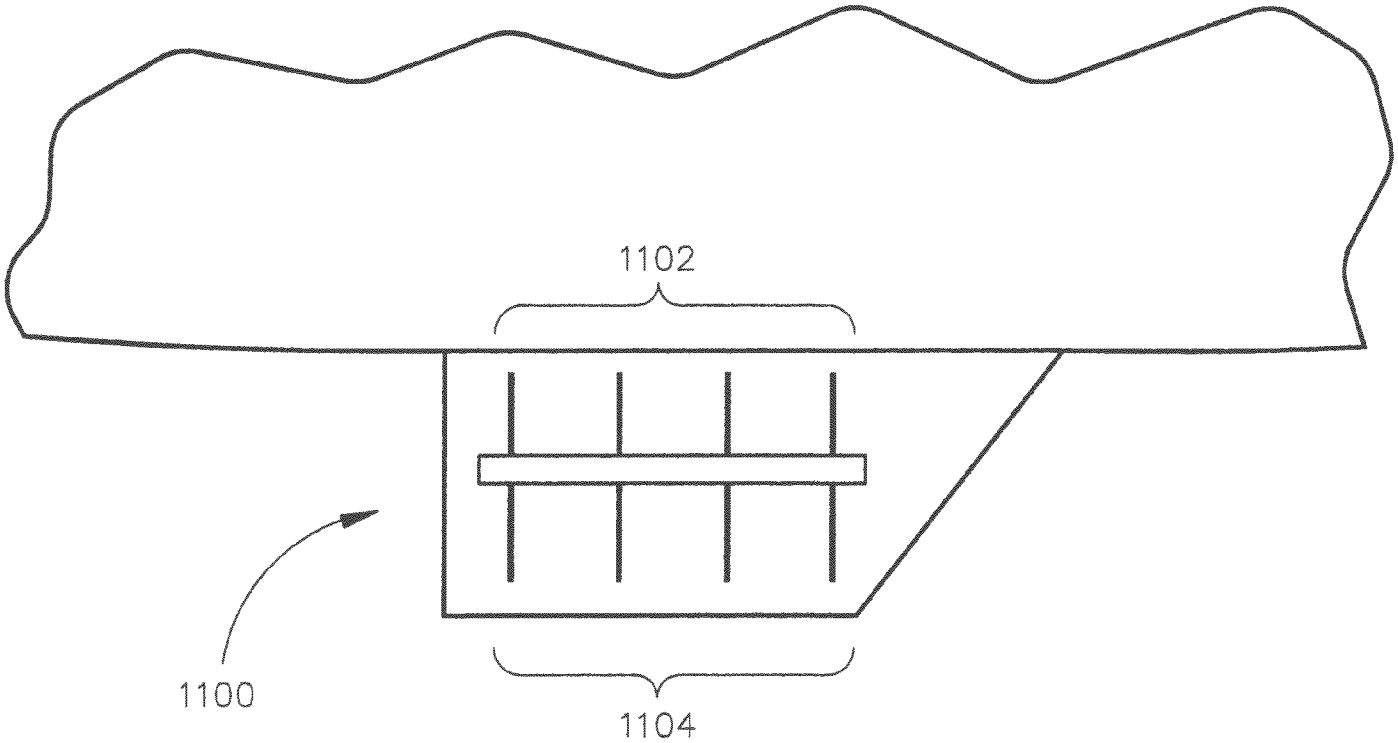
FIG. 11 is an illustration depicting a directional antenna system with a stacked antenna array.

Referring now to FIG. 11, an illustration depicting an alternative directional antenna system 1100 is shown. The directional antenna system 1100 is similar to the directional antenna system 100 as described above, with the addition of a second linear antenna array. The antenna elements in the linear antenna arrays 1102 and 1104 may be oriented in the same manner, and jointly form a vertically stacked linear antenna array as shown in FIG. 11. The stacked array is capable of providing more antenna gain, which may be appreciated in various applications. It is understood, however, that the stacked array may increase the physical size of the antenna system 1100 (compared to the antenna system 100), and whether to utilize the stacked array implementation may be determined based on various design factors and constraints.

Figure 12:
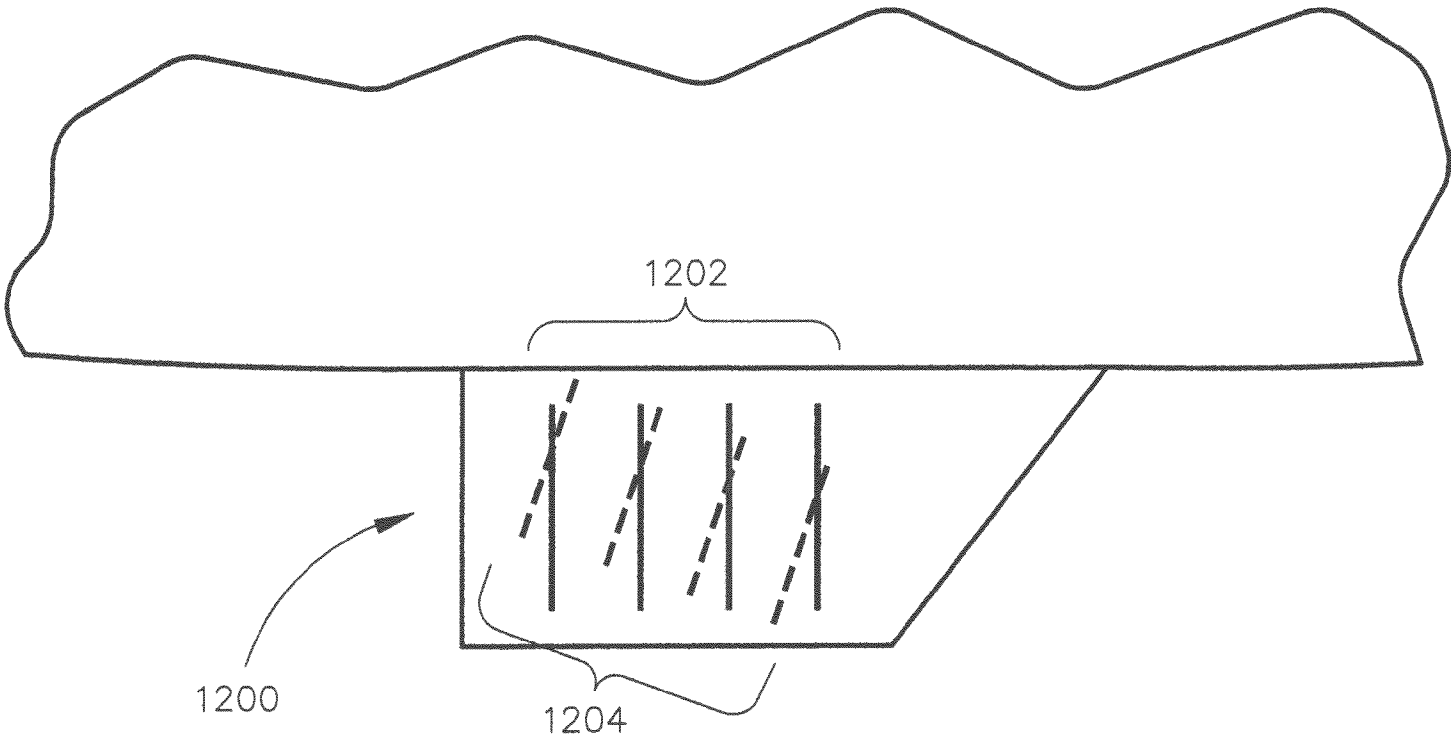
FIG. 12 is an illustration depicting a directional antenna system with a plurality of co-existing antenna arrays.

Referring now to FIG. 12, an illustration depicting another alternative directional antenna system 1200 is shown. The antenna system 1200 includes two or more linear antenna arrays oriented differently with respect to each other for providing different directional beams. For instance, the antenna elements of the first antenna array 1202 may be oriented so that they are perpendicular to the lateral axis of the aircraft (as previously described). On the other hand, the antenna elements of the second antenna array 1204 may be oriented similarly as the antenna elements of the first antenna array 1202, but tilted/rotated by a predetermined angle towards the ground. In this manner, the antenna controller may selectively activate one of the antenna arrays to optimize the communication with the ground station(s). It is contemplated that such abilities may be appreciated as the antenna system 1200 does not require any mechanically moving parts (therefore reduces the physical profile and cost). It is also contemplated that additional linear antenna arrays may co-exist with the two exemplary linear antenna arrays 1202 and 1204.

The directional antenna systems in accordance with the present disclosure provide several advantages. For example, the directional antenna may be utilized to reject unwanted ground stations (e.g. in urban environments where ground stations may be close together and may have high user traffic) and direct communications with regions known to be lower in data traffic or having fewer towers (less interferences). The ability to reject unwanted ground stations (may also be known as pointing null to the unwanted ground stations) may be appreciated especially when traveling through urban areas. The directional antenna may also enable a "Smart Antenna" system where elements are driven such that desired ground towers are provided highest gain and undesired towers are provided lower gain. The smart antenna system may utilize channel measurement and signal processing to develop the required beam and pointing. Optionally, beam forming may be derived from direction, bearing and tower database information, as disclosed in co-pending U.S. patent application Ser. No. 12/891,139 filed on Sep. 27, 2010 and entitled "Airborne Cell Tower Selection System and Method," which is incorporated herein by reference.

It may be appreciated that the directivity provided by the antenna of the present disclosure not only reduces the field of view of ground cellular stations (reduces transmit and receive interferences), but also provides greater antenna gain (dB) compare to other configurations. For instance, the antenna stacks as described above have narrower beams and therefore may provide much greater gain than a simple dipole antenna. The greater gain may provide the ability to "close" air-to-ground links over significant distances particularly in areas having few tower assets, allowing the aircraft to cross larger areas that may not have ground stations (e.g., desert or mountainous areas) for 50 to 75 miles or more. The large antenna gain capability uniquely allows the aircraft to close RF link with ground towers that have antenna beam pointed downward instead of skyward. Beam losses represent 30 dB or more. Furthermore, greater antenna gain may also enable better utilizations of the high bit rates available on existing and further cellular networks. For instance, the antenna of the present disclosure may provide 6 to 12 dB of gain (or higher depending on the specific frequency band being used). The greater gain provided utilizing the antenna of the present disclosure also improves link margins and may support more network activities such as live video streaming as well as other live and timely content deliveries.

In addition, the small physical profile of the directional antenna system in accordance with the present disclosure allows more than one of them to be installed on an aircraft. The more than one directional antenna systems may be utilized jointly to achieve high antenna gain, or they may be utilized to support simultaneous communication with different ground stations to improve data reliability and continuity.

Furthermore, it is contemplated that the directional antenna in accordance with the present disclosure is not required to be installed on a downwardly facing surface of the aircraft. For instance, the directional antenna may also be installed on the top surface of the aircraft (e.g., on the top of the fuselage, wherein the directional antenna is oriented upside-down with respect to FIG. 1, for example). Such a configuration may be appreciated in certain applications as the aircraft body may act as a ground plane, which may block signals from unwanted ground stations (especially from the two sides of the aircraft).

Figure 13:
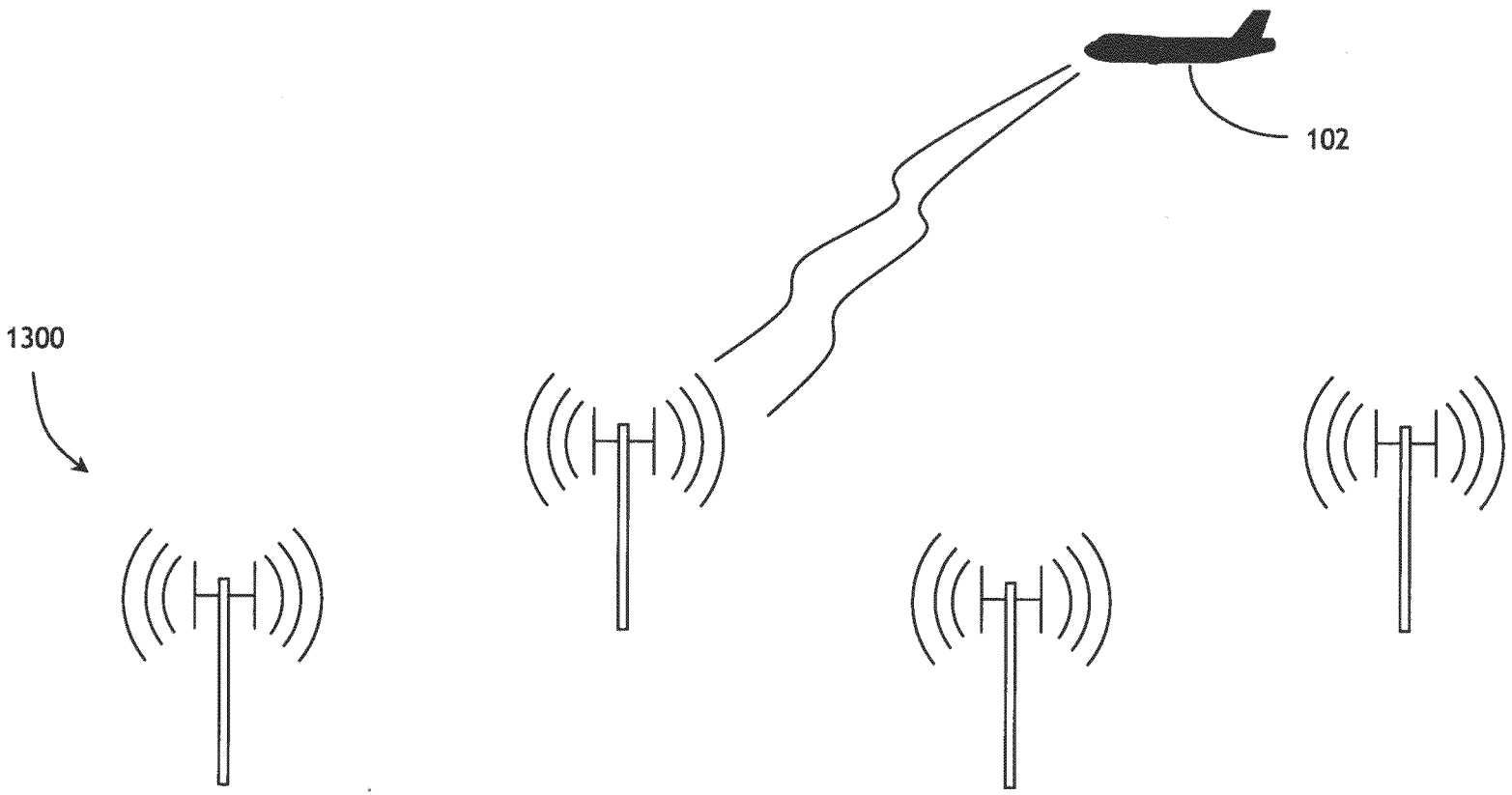
FIG. 13 illustrates the directional antenna system onboard the aircraft in communication with a ground-based cellular network.

It may be appreciated that the exemplary embodiments described above are configured to be compatible with commercially available cellular network infrastructures. That is, the directional antenna systems in accordance with the present disclosure may be utilized with no special requirement on the ground-based cellular network 1300 as shown in FIG. 13. It is contemplated, however, that a customized ground-based cellular network may also be utilized.

Figure 14:
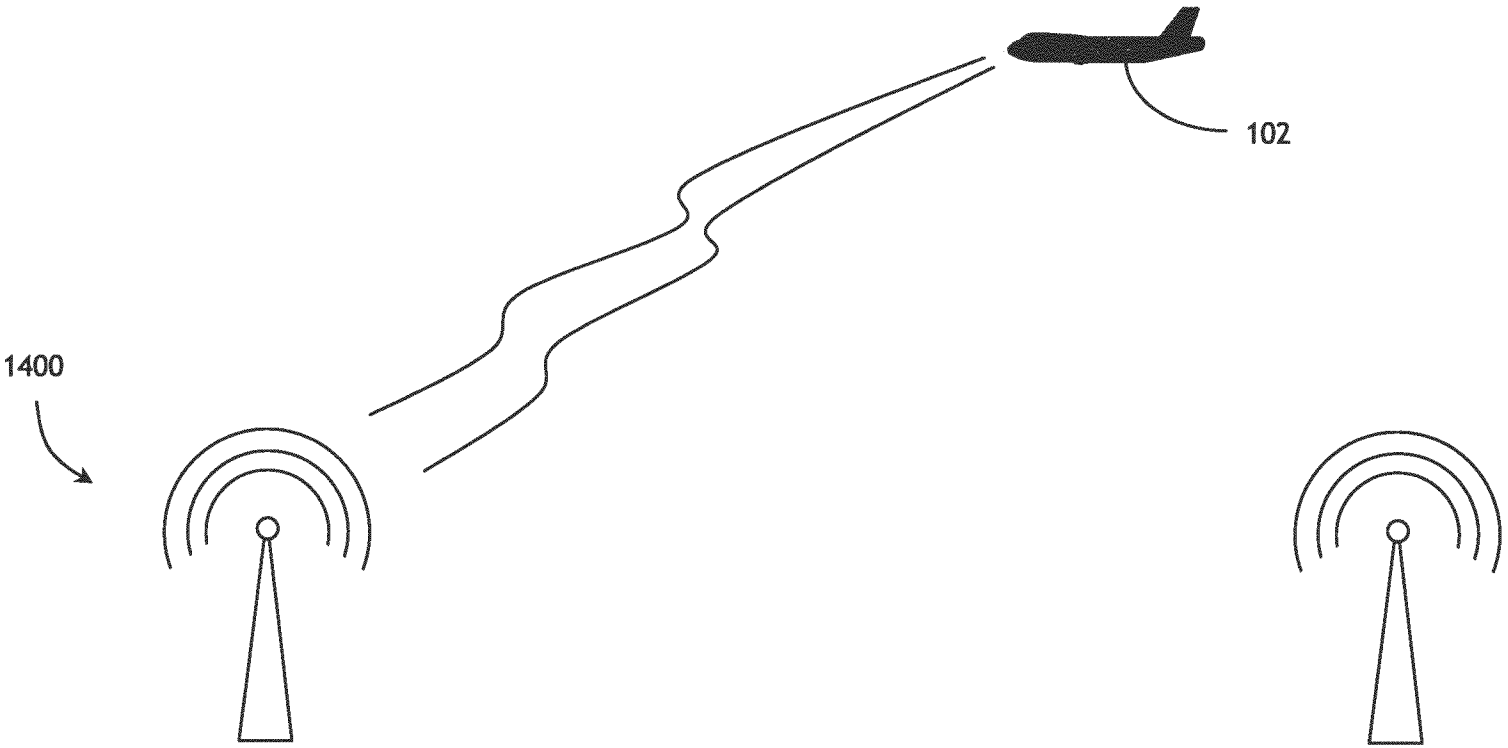
FIG. 14 illustrates the directional antenna system onboard the aircraft in communication with a customized ground-based cellular network.

FIG. 14 is an illustration depicting the aircraft 102 and a customized ground-based cellular network 1400. Similar to the commercially available cellular networks, the customized ground-based cellular network 1400 may also be communicatively connected to one or more service/content providers and capable of broadcasting signals provided by these service/content providers. However, the towers in the customized ground-based cellular network 1400 may be configured to broadcast their signals slightly upward (or toward the sky in certain implementations). Such towers may also be configured to broadcast with greater signal powers/gains (in comparison with conventional cellular towers), which may increase their bandwidth as well as coverage areas (thus less number of towers may be required). It is understood, however, whether to utilize a commercially available cellular network or a customized network may be determined without departing from the spirit and scope of the present disclosure.

It is understood that the present invention is not limited to any underlying implementing technology. The present invention may be implemented utilizing any combination of software and hardware technology. The present invention may be implemented using a variety of technologies without departing from the scope and spirit of the invention or without sacrificing all of its material advantages.

It is understood that the specific order or hierarchy of steps in the processes disclosed is an example of exemplary approaches. Based upon design preferences, it is understood that the specific order or hierarchy of steps in the processes may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A directional antenna, comprising:

an enclosure positioned on an aircraft;

a first linear antenna array disposed within the enclosure, the first linear antenna array having a plurality of antenna elements physically oriented in a first orientation, the plurality of antenna elements being positioned along a longitudinal axis of the aircraft and being spaced apart from each other by a predetermined distance center-to-center;

a second linear antenna array disposed within the enclosure, the second linear antenna array having a plurality of antenna elements physically oriented in a second orientation and spaced apart from each other by the predetermined distance center-to-center, wherein the second orientation is different from the first orientation; and a controller in communication with each of the plurality of antenna elements of the first linear antenna array and each of the plurality of antenna elements of the second linear antenna array, the controller configured to selectively activate at least one of the first linear antenna array and the second linear antenna array, the controller further configured to independently control a RF phase angle of each of the plurality of antenna elements of the first linear antenna array and each of the plurality of antenna elements of the second linear antenna array, allowing the linear antenna array to concentrate RF radiations in a particular wavelength generally toward at least one ground station.

2. The directional antenna of claim 1, further comprising a tilt mechanism configured to tilt at least one of: the first linear antenna array and the second linear antenna array.

3. The directional antenna of claim 2, wherein the tilt mechanism provides linear downtilt for at least one of: the first linear antenna array and the second linear antenna array.

4. The directional antenna of claim 1, wherein two adjacent antenna elements of the plurality of antenna elements of each of the first linear antenna array and the second linear antenna array are spaced apart by approximately one quarter of the wavelength center-to-center.

5. The directional antenna of claim 1, wherein the controller is further configured to independently control an antenna gain of each of the plurality of antenna elements.

6. The directional antenna of claim 1, wherein each of the plurality of antenna elements of the first linear antenna array is oriented perpendicular to a lateral axis of the aircraft.

7. A directional antenna, comprising:

an enclosure positioned on an aircraft;

a linear antenna array disposed within the enclosure, the linear antenna array having a plurality of antenna elements physically oriented in a same orientation, the plurality of antenna elements being spaced apart from each other by a predetermined distance center-to-center;

a tilt mechanism configured to provide mechanical tilting of the linear antenna array;

a controller in communication with the tilt mechanism and each of the plurality of antenna elements of the linear antenna array, the controller configured to control the tilt mechanism and a RF phase angle of each of the plurality of antenna elements, allowing the linear antenna array to concentrate RF radiations in a particular wavelength generally toward at least one ground station to facilitate an air-to-ground communication.

8. The directional antenna of claim 7, wherein the directional antenna system is positioned on an aircraft, and wherein the controller is in communication with an aircraft positioning device and a ground station database, and the controller is configured to control the tilt mechanism and the RF phase angle of each of the plurality of antenna elements based on a position of the aircraft and at least one ground station available to the aircraft.

9. The directional antenna of claim 7, wherein two adjacent antenna elements of the plurality of antenna elements are spaced apart by approximately one quarter of the wavelength center-to-center.

10. The directional antenna of claim 7, wherein each of the plurality of antenna elements comprises at least one of: a blade antenna, a dipole antenna, a monopole antenna, a patch antenna, a folded antenna, a loop antenna, or a stripline antenna.

11. The directional antenna of claim 7, wherein the directional antenna system is positioned on an aircraft, and wherein each of the plurality of antenna elements is oriented perpendicular to a lateral axis of the aircraft.

12. A directional antenna, comprising:

an enclosure positioned on an aircraft;

a first linear antenna array disposed within the enclosure, the first linear antenna array having a plurality of antenna elements physically oriented in a first orientation and spaced apart from each other by a predetermined distance center-to-center;

a second linear antenna array disposed within the enclosure, the second linear antenna array having a plurality of antenna elements physically oriented in a second orientation and spaced apart from each other by the predetermined distance center-to-center, wherein the second orientation is different from the first orientation;

a controller in communication with the each of the plurality of antenna elements of the first linear antenna array and each of the plurality of antenna elements of the second linear antenna array, the controller configured to selectively activate at least one of the first linear antenna array or the second linear antenna array, the controller further configured to independently control a RF phase angle of each of the plurality of antenna elements of the first linear antenna array and each of the plurality of antenna elements of the second linear antenna array, allowing the linear antenna array to concentrate RF radiations in a particular wavelength generally toward at least one ground station to facilitate an air-to-ground communication.

13. The directional antenna of claim 12, wherein the directional antenna system is positioned on an aircraft, and wherein the plurality of antenna elements of the first linear antenna array is being positioned along a longitudinal axis of the aircraft.

14. The directional antenna of claim 12, wherein the directional antenna system is positioned on an aircraft, and wherein the first orientation is perpendicular to a lateral axis of the aircraft.

15. The directional antenna of claim 12, wherein the first orientation is orthogonal with respect to the second orientation.

16. The directional antenna of claim 12, wherein the directional antenna system is positioned on an aircraft, and wherein the first orientation is perpendicular to a lateral axis of the aircraft and the second orientation is perpendicular to the first orientation.

17. The directional antenna of claim 12, wherein the second orientation is rotated by a predetermined angle with respect to the first orientation.

18. The directional antenna of claim 12, further comprising a tilt mechanism configured to tilt at least one of: the first linear antenna array or the second linear antenna array.

19. The directional antenna of claim 12, wherein the directional antenna system is positioned on an aircraft, and wherein the controller is in communication with an aircraft positioning device and a ground station database, and the controller is configured to control the RF phase angle of each of the plurality of antenna elements of the first linear antenna array and each of the plurality of antenna elements of the second linear antenna array based on a position of the aircraft and at least one ground station available to the aircraft.

20. The directional antenna of claim 12, wherein each of the plurality of antenna elements of the first linear antenna array and each of the plurality of antenna elements of the second linear antenna array comprises at least one of: a blade antenna, a dipole antenna, a monopole antenna, a patch antenna, a folded antenna, a loop antenna, or a stripline antenna.

* * * * *